US007461494B2

(12) United States Patent
Frezza

(10) Patent No.: US 7,461,494 B2
(45) Date of Patent: Dec. 9, 2008

(54) SILL PLATE

(75) Inventor: Joseph A. Frezza, Flemington, NJ (US)

(73) Assignee: Construction Solutions, LLC, Old Westbury, NY (US)

( * ) Notice: Subject to any disclaimer, the term of this patent is extended or adjusted under 35 U.S.C. 154(b) by 0 days.

(21) Appl. No.: 11/036,711

(22) Filed: Jan. 14, 2005

(65) Prior Publication Data

US 2005/0183361 A1 Aug. 25, 2005

Related U.S. Application Data

(60) Provisional application No. 60/543,757, filed on Feb. 11, 2004.

(51) Int. Cl.
*E04C 3/00* (2006.01)
*E04C 2/34* (2006.01)
*E04F 19/04* (2006.01)

(52) U.S. Cl. ..... 52/846; 52/241; 52/290; 52/481.2; 52/836; 52/846

(58) Field of Classification Search ..... 52/730.1, 52/731.1, 731.4, 731.5, 731.9, 733.2, 745.09, 52/481.1, 483.1, 293.3, 241, 290, 481.2, 52/836, 846
See application file for complete search history.

(56) References Cited

U.S. PATENT DOCUMENTS 3,101,817 A * 8/1963 Radek ..... 52/241
3,286,420 A * 11/1966 Lewis ..... 52/241
3,292,328 A * 12/1966 Darling et al. ..... 52/238.1
3,533,205 A * 10/1970 Lankford et al. ..... 52/356
3,696,569 A * 10/1972 Didry ..... 52/126.4
3,877,193 A * 4/1975 Hall ..... 52/665
3,900,996 A * 8/1975 Yohe ..... 52/241
4,151,691 A * 5/1979 Wendt ..... 52/242
4,651,484 A * 3/1987 Rutkowski ..... 52/241
5,950,385 A * 9/1999 Herren ..... 52/481.1
6,360,510 B1 * 3/2002 Woodrum et al. ..... 52/731.1
6,516,580 B1 2/2003 Maietta (Continued)

OTHER PUBLICATIONS

The Construction Weekly Engineering News-Record, Apr. 5, 2004, McGraw Hill Construction, The McGraw-Hill Companies, Avoid Getting Floored With The Cost of Mold Abatement, J. A. Frezza & Associates, L.L.C., The Construction Weekly, Apr. 5, 2004, p. M1.

*Primary Examiner*—David R Dunn
*Assistant Examiner*—Danielle Jackson
(74) *Attorney, Agent, or Firm*—Lerner, David, Littenberg, Krumholz & Mentlik, LLP

(57) ABSTRACT

A sill plate adapted to support drywall above a floor surface to prevent the formation of mold in the drywall. The sill plate has a base section and a first wall associated with the base section. A first shelf is associated with the first wall. The first shelf is adapted to support drywall. The sill plate may also include a second wall associated with base section where the second wall is opposed from the first wall. The second wall may include a second shelf associated with the second wall. Each of the first shelf and second shelf may extend along a plane parallel to a plane passing through the base section. Drywall may rest on the first shelf prior to being affixed to vertical studs extending from the sill plate.

21 Claims, 3 Drawing Sheets

U.S. PATENT DOCUMENTS 6,588,165 B1 7/2003 Wright
6,647,691 B2 11/2003 Becker et al.
6,691,992 B1 2/2004 Mungo
6,837,012 B2 * 1/2005 Scherrer et al. ..... 52/290
6,871,470 B1 * 3/2005 Stover ..... 52/648.1
7,127,862 B2 * 10/2006 Saldana ..... 52/715

* cited by examiner

SILL PLATE

CROSS REFERENCE TO RELATED APPLICATIONS

This application claims the benefit of the filing date of U.S. Provisional Patent Application No. 60/543,757 filed Feb. 11, 2004, the disclosure of which is hereby incorporated herein by reference.

BACKGROUND OF THE INVENTION

Steel stud framing, such as light or heavy gauge steel framing, is well known and often used in both commercial and residential construction. Such framing is typically utilized to construct interior partition walls and generally consists of sill plates or channels located at the top and bottom of a wall, with studs extending between the channels, much like more traditional wooden sill plates and wooden studs. Both the sill plates and the studs are typically C-shaped or U-shaped. The studs are typically affixed to the channels by mechanical fastening means, such as self-tapping screws. Once all of the electrical and mechanical appurtenances have been installed between the studs, drywall may then be attached to the studs, again typically with mechanical fastening means, to complete the wall.

In a majority of construction projects, the lower-most sheet of drywall is installed first, with the subsequent sheets being placed on top of the lower sheets for temporary support during construction. When installed in this manner, installers will typically place the lower-most sheet of drywall directly on the floor surface adjacent to the sill plate. Because the floor surfaces of construction sites, particularly commercial sites and residential basements, tend to be formed from concrete, moisture may wick through the concrete and into the drywall through capillary action. This situation promotes the formation of mold in the drywall.

Mold is problematic for drywall in that it causes staining and general discoloration. Mold may also cause the drywall to disintegrate over time, or begin to emit an odor. The formation of certain molds may be a health detriment to individuals exposed to the mold or spores therefrom which may travel away from the spore source, for example, by becoming airborne from forced air heating or cooling. Thus, mold in any area of a structure may taint the entire structure. Such health problems may range in minor cases from allergic reactions to actual sicknesses in severe cases.

Installers with knowledge and concern for the mold growth phenomenon are preferably careful to avoid contact between drywall and concrete floors. To prevent such contact, installers may use drywall shims or wedges between the floor and the drywall during construction. Once the drywall is attached to the studs, the shims or wedges should then be removed to prevent moisture from wicking from the floor to the drywall through the shims or wedges. Often, installers simply leave the shims or wedges in place despite this concern.

Other methods of temporarily supporting the first sheet of drywall off of the floor surface during installation of the drywall are also commonly utilized. One such method is the use of a bent steel wedge. In this method, an installer places one end of a long and slender piece of steel which is curved beneath the drywall such that the curved ends face up. The installer then steps on the free end to lower the free end and elevate the end beneath the drywall. Once the drywall is elevated, the installer may affix the drywall to the studs and then remove the bent steel wedge.

This method is problematic as it is often difficult to coordinate use of a bent steel wedge with one's foot while simultaneously holding and attempting to affix a piece of drywall to the studs. Additional helpers may be useful, but their use affects overall project efficiency by requiring additional man-hours of labor.

Regardless of the method utilized by the installer, irregularities in the floor surface may also cause contact between the drywall and the floor. For example, even a diligent installer who places shims on each end of a drywall section may encounter an uneven floor which is raised in the middle portion such that the middle portion makes contact with the drywall despite the installer's best efforts. In such cases, additional shims must be provided or the drywall will contact the floor in that middle portion. Use of additional shims slows the installation and affect overall project efficiency.

Even where drywall is placed above the surface of a floor, it is often placed with too little of a gap to avoid becoming moist. Drywall should be placed a minimum of ⅜-inch and preferably approximately ½-inch above the floor surface to prevent moisture from the floor surface from wicking into the drywall. These heights also help to keep the drywall dry in the case of unintended spills, floods or the like, or routine cleaning efforts. Even a diligent installer may only place the drywall approximately ¼-inch or less above the floor when using the prior art methods of temporarily elevating the drywall discussed above. Often, this may still lead to mold growth.

Thus, it would be beneficial to provide a sill plate which incorporates features which inherently prevent drywall from contacting a floor surface, and which can maintain a proper elevation above a floor surface on a consistent basis.

SUMMARY OF THE INVENTION

The present invention overcomes the shortcomings of the prior art by providing a sill plate having features designed to elevate drywall on a consistent basis from a floor surface.

In accordance with one aspect of the present invention, there is provided a sill plate comprising a base section, a first wall associated with the base section, and a first shelf associated with the first wall, wherein the first shelf is adapted to support drywall.

The sill plate may further comprise a second wall associated with the base section, the second wall opposed from the first wall. The sill plate may further comprise a second shelf associated with the second wall, the second shelf adapted to support drywall. The first wall and the second wall may have exterior surfaces facing away from each other, wherein the first shelf may be associated with the exterior surface of the first wall and the second shelf may be associated with the exterior surface of the second wall. The first wall, the base section, and the second wall may form a generally C-shaped cross section.

The base section may be relatively flat so as to form a base section plane, the first shelf extending from the first wall along a plane generally parallel to the base section plane.

The first shelf may be located above the base section. The location may be approximately ½-inch above the base section.

The first wall may be formed integrally with the base.

The sill plate may further comprise a first flap associated with the first wall, the first shelf formed from a portion of the first flap.

In accordance with further aspects of the present invention, a sill plate for steel stud framing may comprise a base section having a first edge and a second edge, a first wall extending generally perpendicular to the first edge of the base, and a first shelf extending from the first wall along a plane generally parallel to a plane formed by the base section, wherein the first shelf is adapted to support drywall.

The sill plate may further comprise a second wall extending generally perpendicular to the second edge of the base section. The sill plate may further comprise a second shelf extending from the second wall along a plane generally parallel to a plane formed by the base section, the second shelf adapted to support drywall. The first wall, the base section, and the second wall may form a generally C-shaped cross section.

The first shelf may be located above the base section. The location may be approximately ½-inch above the base section.

In accordance with still further aspects of the present invention, a method of erecting a wall may comprise installing a sill plate against a floor surface, the sill plate comprising a base section, a first wall extending from the base section, and a first shelf associated with the first wall, the first shelf extending along a plane substantially parallel to a plane formed by the base section, installing studs adjacent the first wall, supporting a first sheet of drywall on the first shelf above the floor surface, and affixing the first sheet of drywall to the studs.

The sill plate may further comprise a second wall extending from the base section and a second shelf associated with the second wall, the second shelf extending along a plane substantially parallel to a plane formed by the base section, the method further comprising supporting a second sheet of drywall on the second shelf above the floor surface, and affixing the second sheet of drywall to the studs. The step of installing studs adjacent the first wall may locate the studs between the first wall and the second wall. The step of supporting drywall on the first shelf may elevate the drywall above the floor surface at least ¼-inch.

In accordance with additional aspects of the present invention, a kit of components for use in the construction of steel stud framing may comprise a sill plate, the sill plate comprising a base section, a first wall associated with the base section, a first shelf associated with the first wall, the first shelf adapted to support drywall, and at least one stud.

BRIEF DESCRIPTION OF THE DRAWINGS

The subject matter regarded as the invention is particularly pointed out and distinctly claimed in the concluding portion of the specification. The invention, however, both as to organization and method of operation, together with the features, objects, and advantages thereof, may best be understood by reference to the following detailed description when read with the accompanying drawings in which:

DETAILED DESCRIPTION

Figure 1:
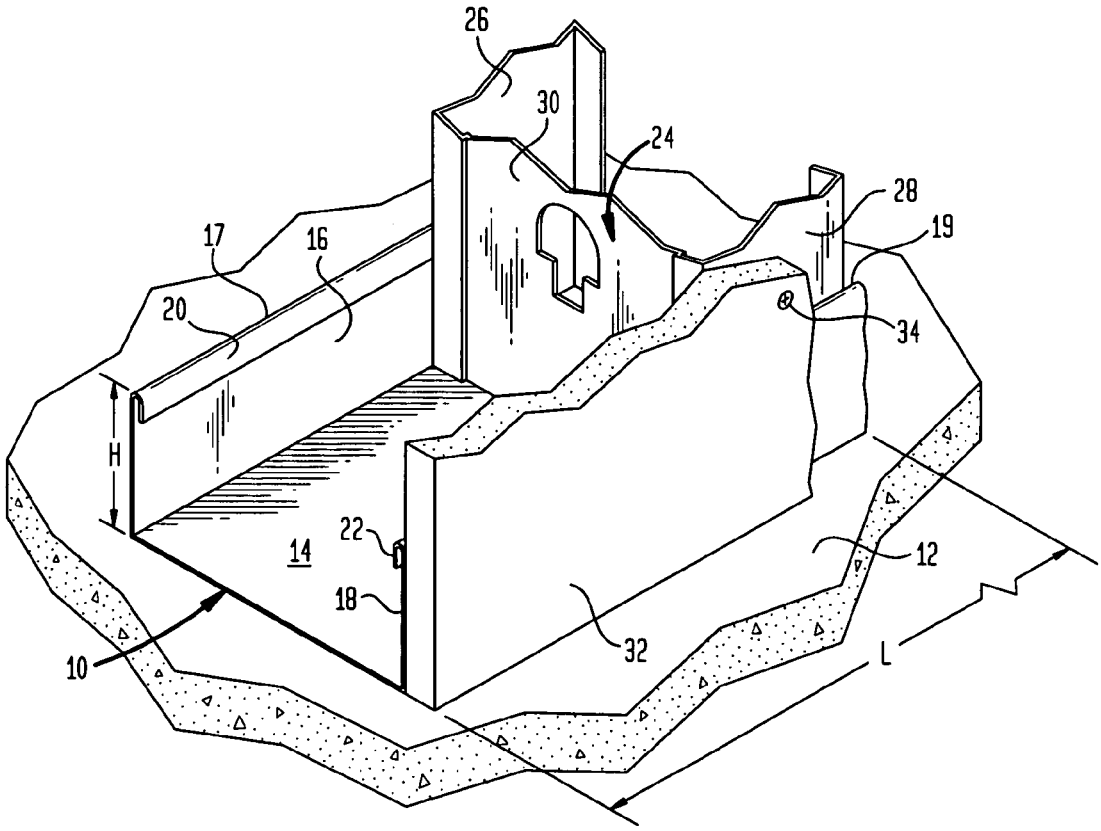
FIG. 1 (PRIOR ART)
FIG. 1 is a cut-away perspective view of a conventional steel stud framing system.

In the following are described the preferred embodiments of the sill plate in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

In this regard, applicant has used the term sill plate extensively throughout this application to describe the underlying inventive structure. The term sill plate is believed to be the preferred terminology throughout the construction industry for describing the lower-most horizontal member of a framing system, or that member of a structural system which rests on the foundation and supports the wall uprights. Sill plates may also be referred to in the industry as shoe plates, bottom runners, or runner tracks. Other terminology such as the simple generic terms channel or track may also be used in the industry. Notwithstanding the terminology used, each is generally considered to be of the same structural nature, and may be used interchangeably as applicable.

Referring to the drawings, and initially to FIG. 1, a conventional sill plate 10 is shown affixed to a floor surface 12. The sill plate 10 comprises a horizontal base 14 with a first wall 16 and a second wall 18 extending vertically upward and generally perpendicular from the base. At the edges 17, 19 of each wall 16, 18, the wall may be bent inward, or toward each other, and downward toward the base 14 to form a first flap 20 and second flap 22. The flaps 20, 22 add to the structural integrity of the sill plate 10 while also increasing handling safety by eliminating potentially sharp wall edges.

Conventional sill plates 10, such as the sill plate shown in FIG. 1, are common throughout the industry. Typically, such sill plates are manufactured in lengths "L" measured by the foot, such as 8-feet, 10-feet, 12-feet, or 16-feet lengths. Overall heights "H" are typically 1-inch to 1¼-inch. In each case, the dimensions may be varied depending on the circumstances. For example, each of the walls may be shorter than 1-inch, or higher than 1¼-inch. In addition, the walls need not be identical in height. Rather, the walls may be formed to different heights, if the application so provides. Typically however, the walls will be of the same height, which is approximately between 1-inch and 1¼-inch.

FIG. 1 also depicts a vertical stud 24 resting on the base 14 of the sill plate 10 between the first wall 16 and the second wall 18. Although not shown, the studs 24 are typically attached to the first wall 16 and second wall 18 with fastening means. Conventionally, such fastening means comprise mechanical fasteners, such as self-tapping screws. However, chemical fastening systems may also be utilized. Such systems include various glues and multi-part epoxies.

Studs 24 are generally C-shaped, and may comprise a first side 26 and a second side 28 spanning between a central portion 30. As shown in FIG. 1, the first side 26 of stud 24 is generally installed adjacent to the first wall 16 of sill plate 10 with the second side 28 of the stud installed adjacent to the second wall 18 of the sill plate, such that the central portion 30 of stud 24 spans across the length "L" of the sill plate.

Non-C-shaped studs 24 may also be provided. For example, in some framing systems, the base portion of the stud, or that portion which connects to the sill plate 10, may be formed from a conventional wood stud while the upper section is C-shaped. In addition, conventional wood studs may be utilized. Notwithstanding, in a conventional framing system, the studs are preferably C-shaped.

Drywall 32, depicted as resting on the floor 12 in the conventional manner, is then secured to the exterior of the second side 28 of stud 24 with fastening means, such as self-tapping screws 34. Similarly, a second piece of drywall (not shown) may be secured to the exterior of first side 26 of the stud 24.

As previously discussed, because floor surfaces 12 may be formed from concrete, moisture may wick from the floor into the drywall 32. Even if the floor 12 is relatively free of moisture, moisture may reach the drywall 32 through other means if the drywall is installed close to the floor. For example, spills, either accidental or from routine cleaning, may moisten the portions of the drywall 32 closest to the floor 12. These situations promote the formation of mold in the drywall 32.

Figure 2:
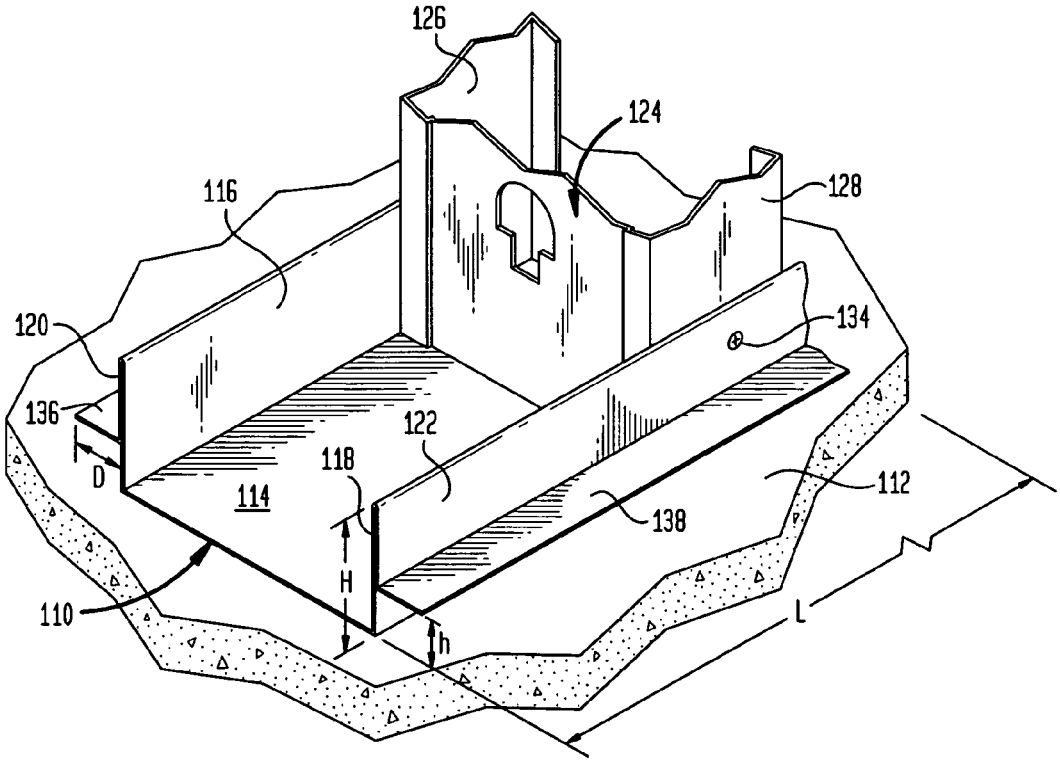
FIG. 2 is a cut-away perspective view of a steel stud framing system utilizing a sill plate incorporating features in accordance with certain aspects of the present invention.
Figure 3:
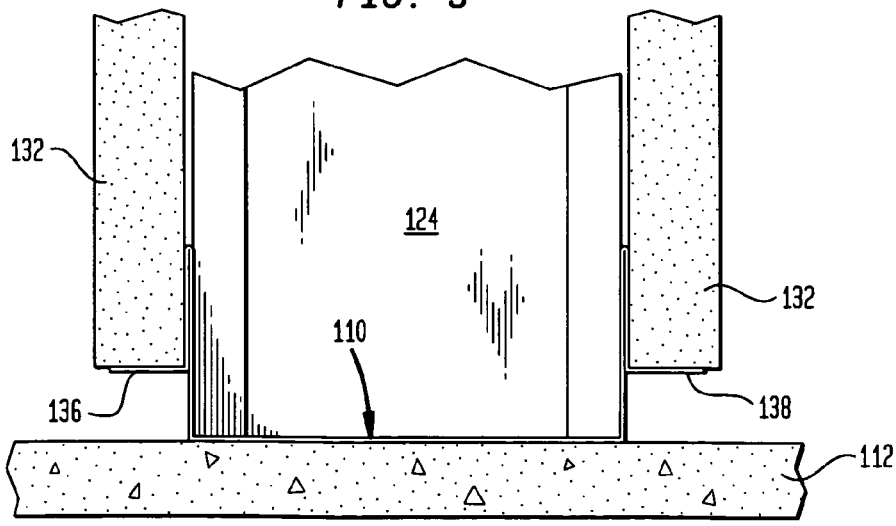
FIG. 3 is a cut-away side view of wall construction utilizing a sill plate incorporating features in accordance with certain aspects of the present invention.

As shown in FIGS. 2 and 3, a sill plate 110 configured in accordance with certain aspects of the present invention may include features designed to prevent the drywall 132 from resting on the floor 112, irrespective of the skills or desires of the installer. The sill plate 110 may comprise a horizontal base 114 with a first wall 116 and second wall 118 extending vertically therefrom. In this regard, the sill plate 110 shown in FIGS. 2 and 3 is much like the conventional sill plate 10 shown in FIG. 1.

However, the sill plate 110 may also be provided with features designed to elevate the drywall 132 on a consistent basis from the floor surface 112. Rather than including first flap 20 and second flap 22 bent toward the inside of the sill plate 10 as is included in the conventional sill plate shown in FIG. 1, the sill plate 110 shown in FIGS. 2 and 3 and configured in accordance with certain aspects of the present invention may include a first flap 120 and a second flap 122 bent approximately 180 degrees toward the outside of the sill plate 110. Thus, portions of flaps 120, 122 may be substantially parallel to walls 114, 116, respectively.

As shown in FIG. 2, first flap 120 may form a first shelf 136 and second flap 122 may form a second shelf 138. The first shelf 136 may extend outward from the first wall 116 along a plane substantially parallel to a plane passing through base 114. Likewise, second shelf 138 may extend outward from the second wall 118 along a plane parallel to a plane passing through base 114. Each of the first shelf 136 and second shelf 138 is preferably raised from the floor 112 above the level of base 114 by a height "h." In certain embodiments, the shelves 136, 138 may be approximately ¼-inch to ¾-inch above the floor 112. In a preferred embodiment, the shelves 136, 138 are approximately ½-inch above the floor 112. In other embodiments, the shelves 136, 138 may be approximately ¼-inch to ½-inch above the floor 112. In still further embodiments, the shelves 136, 138 may be approximately ½-inch to ¾-inch above the floor 112. Additional configurations are also possible, depending on the design criteria.

In addition, the shelves 136, 138 may each be formed to different heights "h" above the floor 112. For example, first shelf 136 may be ½-inch above the floor 112 while second shelf 138 may be ¾-inch above the floor. In other embodiments, first shelf 136 may be ¼-inch above the floor while second shelf 138 may be ½-inch above the floor. Other such configurations are also possible.

Because the heights "h" of the shelves 136, 138 may be meticulously controlled, the drywall 132 installed on a particular project may be affixed to the studs at controlled heights above the floor surface 112. In this regard, it is preferred that adjacent lengths of sill plate 110 on a given project are configured identically such that the height of drywall 132 resting thereon is consistent.

The shelves 136, 138 may be configured to nearly any reasonable depth "D." However, the shelves are preferably configured to a depth of less than approximately ½-inch such that the shelf will not extend beyond the face of a conventional sheet of drywall, such as ½-inch or ⅝-inch drywall, when placed thereon. In addition, the shelf should be sufficiently deep, for example approximately ¼-inch, to adequately support the drywall. It will be appreciated that no matter the depth provided, the shelves 136, 138 should be formed of a material with sufficient thickness and structural rigidity to support the drywall 132 at least on a temporary basis during construction, until the drywall is affixed to the studs 124 by other means.

As shown in FIG. 2, a stud 124 may be fitted within the first wall 116 and second wall 118 of sill plate 110, with the first side 126 and second side 128 of the stud 124 attached with a self-tapping screw 134 or other fastening means to the first wall 116 and second wall 118 of sill plate 110, respectively.

Once the sill plate 110 and studs 124 are assembled, drywall 132 may be placed upon first shelf 136 and second shelf 138, as shown in FIG. 3. The drywall 132 may then be attached to stud 124 with self-tapping screws (not shown) or other fastening means.

Because of the presence of the shelves 136, 138, even the most unaware installer will be forced to install the drywall 132 properly. For example, if the drywall 132 is not placed directly upon the shelves 136, 138, but rather adjacent to the shelves while resting on the floor 112, once the drywall is fastened to the stud 124, the lower portion of the drywall adjacent the shelves will be forced to curve around the shelf and will at least be visually unappealing, and may fracture due to the stress. Accordingly, even an unaware contractor will be forced to utilize the sill plate 110 of the present invention in the correct manner, as the sill plate itself facilitates proper installation of drywall regardless of the knowledge base of the installer.

Accordingly, the present invention provides for the proper installation of drywall in a steel stud framing system without slowing the efficiency of construction. In fact, because the use of shims or bent steel wedges is not required, and the installer has a convenient place to rest drywall during installation, the system should speed up construction in instances where the installer is cognizant of mold and would have attempted to lift the drywall from the floor surface using other methods.

Figure 4:
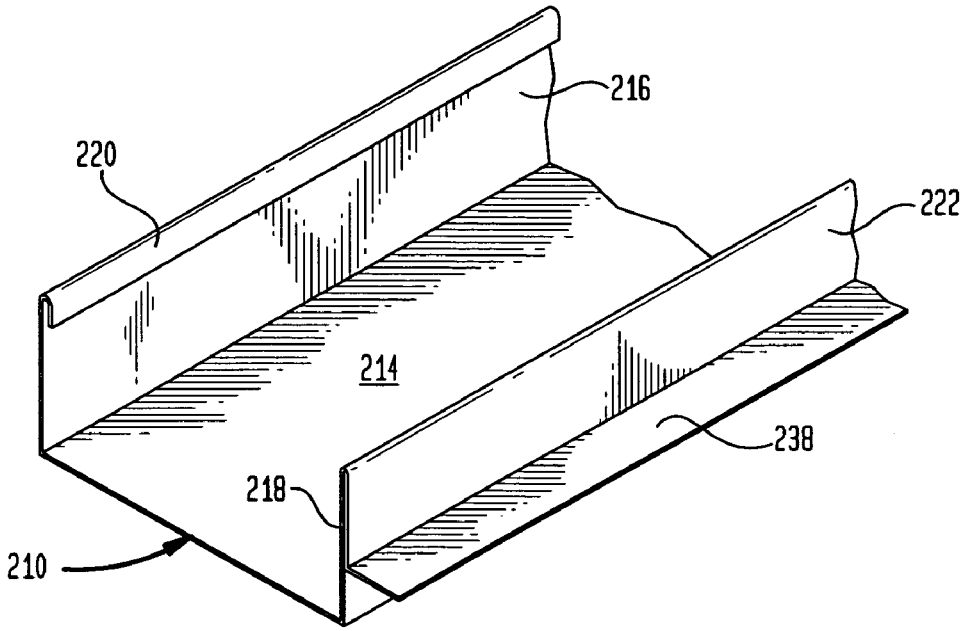
FIG. 4 is a cut-away perspective view of a sill plate in accordance with further aspects of the present invention.

In other embodiments, it will be appreciated that the sill plate may be formed with only a single shelf so the sill plate may be placed against an existing wall. Such a sill plate 210 is shown in FIG. 4. As shown, the sill plate 210 may include a shelf 238 associated with the second wall 218 much like the sill plate 110 shown and described with respect to FIG. 2 and a first flap 220 associated with the first wall 216 much like the first flap 20 of the conventional sill plate 10 shown and described with respect to FIG. 1. In this case, wall 216 may be abutted directly against an existing wall. The sill plate 210 may also be configured to have a shelf associated with the first wall 216 and a flap associated with the second wall 218 in a mirror image of the sill plate 210 shown in FIG. 4. The sill plate 210 may also include a base 214 and second flap 222, as shown in FIG. 4.

Figure 5:
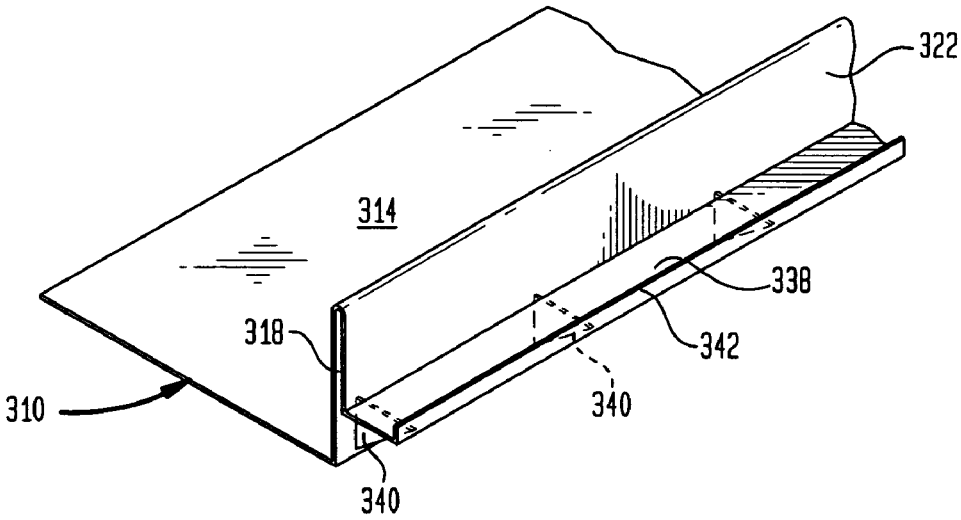
FIG. 5 is a cut away perspective view of a sill plate in accordance with further aspects of the present invention; and, FIG. 6 is a side view of the sill plate of FIG. 5.

In yet another configuration shown in FIG. 5, a sill plate 310 in accordance with certain aspects of the present invention may include only a single wall 318 extending from the base 314. In this regard, the wall 318 may include a shelf 338, much like the shelf 238 shown and described with respect to FIG. 4.

In order to add structural support, any of the sill plates 110, 210, 310, shown and described may include structural flanges to add rigidity. For example, FIG. 5 depicts flanges 340 extending between the shelf 338 and the wall 318 in order to add structural support to the shelf. The flanges 340 may formed integrally with the sill plate 310, or may be affixed thereto utilizing mechanical or chemical means. Commonly, the flanges 340 may be tack welded to a sill plate 310.

FIG. 5 also depicts a lip 342 extending from shelf 338. Although it is preferred not to include such a lip 342, one may be provided if deemed necessary. It will be appreciated that such a lip 342 may help to prevent the drywall 132 from slipping off of the shelf 338 between the time the drywall is rested on the shelf and is affixed to the studs. As an alternative, or in conjunction therewith, the shelf 338 may include surface treatment or surface irregularities designed to increase friction between the shelf and the drywall, to help prevent the drywall from falling off of the shelf between the time the drywall is rested on the shelf and the time the dry wall is affixed to the studs. Such surface treatments and irregularities may include dimples, bumps, ridges, or the like. In preferred embodiments, no lip 342, surface treatments, or surface irregularities are required.

Figure 6:
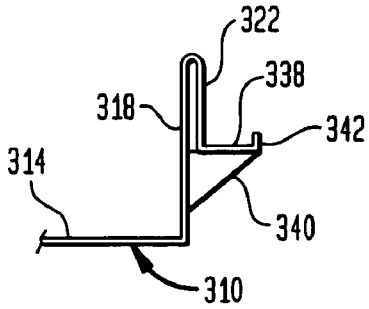

FIG. 6 depicts a side view of the sill plate 310 shown in FIG. 5. As shown most clearly in FIG. 6, the lip 342, if so provided, is preferably relatively short such that an installer may easily place the drywall between the lip and the flap 322. Although depicted as in a solid triangular configuration, it will be appreciated that the flange 340 may be configured in many alternative manners, such as an open triangle or other geometric and non-geometric configurations. In addition, the flange 340 may simply comprise a single bead of welding material to provide a measure of strength to the shelf 338, if so required.

The sill plates shown and described in accordance with the present invention may be formed from metals such as steel or aluminum, plastics, composites, or any other suitable material. Depending on the material, the sill plate may be bent, roll formed, extruded, molded, or formed in other suitable manners.

The preferred manner of forming the sill plate is through roll forming of coiled stock steel. By using the roll forming process, a continuous length of coiled stock may be bent or otherwise formed into shape by feeding the stock between successive pairs of rolls that increasingly shape the material into the desired cross-section. As the continuous length of sill plate exits the roll forming machine, a cutoff machine may cut the continuous roll into predetermined lengths, typically in the range of 8 feet to 16 feet. This method is desirable for mass-produced, quality controlled sill plates.

Although this invention has been described with a certain degree of particularity, it is to be understood that the present disclosure has been made by way of example only in that numerous changes in the detailed construction and the combination and arrangement of parts may be resorted to without departing from the spirit of the invention as hereinafter claimed.

The invention claimed is:

1. A sill plate comprising:

a base section;

a first flap extending from said base section to integrally form a first wall and a first shelf;

said first wall extending from said base section to a first wall end;

said first shelf extending from said first wall from a point between said first wall end and said base section leaving an upper portion of said first wall exposed above said first shelf, said first shelf adapted to support drywall;

a second wall extending from said base section to a second wall end, said second wall opposed from said first wall;

wherein said first shelf extends away from said second wall and is substantially parallel to said base section from said first wall to a free end of said first shelf, the free end being the terminus of said first shelf, and wherein at least part of said upper portion of said first wall is substantially linear.

2. The sill plate of claim 1, further comprising a second flap, said second flap integrally forming said second wall and a second shelf, said second shelf extending from said second wall from a point between said second wall end and said base section leaving an upper portion of said second wall exposed above said second shelf, said second shelf adapted to support drywall;

wherein said second shelf is substantially parallel to said base section from said second wall to a free end of said second shelf, the free end being the terminus of said second shelf, and wherein at least part of said upper portion of said second wall is substantially linear.

3. The sill plate of claim 2, wherein said first wall and said second wall have exterior surfaces facing away from each other, said first shelf associated with said exterior surface of said first wall and said second shelf associated with said exterior surface of said second wall.

4. The sill plate of claim 2, wherein said first wall, said base section, and said second wall form a generally C-shaped cross section.

5. The sill plate of claim 1, wherein said first shelf is located above said base section.

6. The sill plate of claim 5, wherein said first shelf is approximately ½-inch above said base section.

7. The sill plate of claim 1, wherein said first wall is formed integrally with said base section.

8. An elongate sill plate for steel stud framing, said sill plate comprising:

a base section having a first edge and a second edge;

a first wall extending generally perpendicular to the first edge of said base section toward a first wall end;

a first shelf formed continuously from said first wall, the entirety of said first shelf extending from said first wall below said first wall end and above said base section leaving a first wall upper end exposed above said first shelf, the first shelf extending away from the base section to a free end along a plane generally parallel to a plane formed by said base section, said first shelf adapted to support drywall, the free end being the terminus of said shelf;

a second wall extending generally perpendicular to the second edge of said base section, wherein at least a portion of said first wall upper end is substantially linear.

9. The sill plate of claim 8, further comprising a second shelf, the entirety of said second shelf extending to a free end from said second wall along a plane generally parallel to a plane formed by said base section, said second shelf adapted to support drywall.

10. The sill plate of claim 9, wherein said second shelf is formed continuously with said second wall.

11. The sill plate of claim 8, wherein said first wall, said base section, and said second wall form a generally C-shaped cross section.

12. The sill plate of claim 8, wherein said first shelf is located above said base section.

13. The sill plate of claim 12, wherein said first shelf is approximately ½-inch above said base section.

14. A method of erecting a wall, said method comprising:

installing a sill plate against a floor surface, the sill plate comprising a base section, a first wall extending from the base section to a first wall end, a first shelf formed continuously from the first wall, the first shelf extending from the first wall at a point below the first wall end and above the base section, the first shelf extending in its entirety away from the base section to a free end along a plane substantially parallel to a plane formed by the base section, the free end being at the terminus of the first shelf, and a second wall extending from the base;

installing studs adjacent the first wall;

supporting a first sheet of drywall on the first shelf above the floor surface;

affixing the first sheet of drywall to the studs.

15. The method of claim 14, wherein the sill plate further comprises a second shelf associated with the second wall, the second shelf extending in its entirety along a plane substantially parallel to a plane formed by the base section, the method further comprising:

supporting a second sheet of drywall on the second shelf above the floor surface;

affixing the second sheet of drywall to the studs.

16. The method of claim 15, wherein said step of supporting drywall on the first shelf elevates the drywall above the floor surface approximately ¼-inch to ¾-inch.

17. The method of claim 15, wherein the second shelf is formed continuously with the second wall.

18. The method of claim 14, wherein said step of installing studs adjacent the first wall locates the studs between the first wall and the second wall.

19. A kit of components for use in the construction of steel stud framing, said kit comprising:

a sill plate, the sill plate comprising a base section, a first wall extending from said base section to a first wall end, a first shelf formed continuously with said first wall, said first shelf extending from said first wall below said first wall end and above the base section, at least a portion of the section of said first wall spanning between said first shelf and said first wall end being substantially linear, said first shelf being substantially parallel to said base from said first wall to its terminus at a free end away from the base section and being adapted to support drywall, a second wall extending from said base section; and, at least one stud.

20. A sill plate for supporting dry wall in steel stud framing, said sill plate comprising:

an elongate base section having a first edge and a second edge;

a first wall formed integrally with said base section, said first wall extending generally perpendicular from said first edge of said base to a first wall end;

a first flap, said first flap formed integrally with said first wall and said base section, said first flap extending along said first wall toward said base section, said first flap including a linear portion; and a first shelf, said first shelf formed integrally with said first flap, said first wall, and said base, said first shelf extending outwardly away from the base section from a point between said first wall end and said base section to a free end from said first flap substantially parallel to said base, the free end being the terminus of said shelf.

21. The sill plate of claim 20, wherein said sill plate is formed by roll forming.

* * * * *